US009394640B2

(12) United States Patent
Bentley

(10) Patent No.: US 9,394,640 B2
(45) Date of Patent: Jul. 19, 2016

(54) THREAD SENSING STITCH REGULATION FOR QUILTING MACHINES

(71) Applicant: Arthur Bentley, Draper, UT (US)

(72) Inventor: Arthur Bentley, Draper, UT (US)

( * ) Notice: Subject to any disclaimer, the term of this patent is extended or adjusted under 35 U.S.C. 154(b) by 645 days.

(21) Appl. No.: 13/868,101

(22) Filed: Apr. 22, 2013

(65) Prior Publication Data

US 2013/0276686 A1 Oct. 24, 2013

Related U.S. Application Data

(60) Provisional application No. 61/637,012, filed on Apr. 23, 2012.

(51) Int. Cl.

| | |
|---|---|
| ***D05B 19/12*** | (2006.01) |
| ***D05B 59/00*** | (2006.01) |
| ***D05B 11/00*** | (2006.01) |
| ***D05B 45/00*** | (2006.01) |
| ***D05B 69/10*** | (2006.01) |

(52) U.S. Cl.

CPC ..... *D05B 19/12* (2013.01); *D05B 11/00* (2013.01); *D05B 45/00* (2013.01); *D05B 59/00* (2013.01); *D05B 69/10* (2013.01)

(58) Field of Classification Search

CPC ..... D05B 45/00; D05B 11/00; D05B 59/00; D05B 19/12; D05B 69/10

See application file for complete search history.

(56) References Cited

U.S. PATENT DOCUMENTS

| | | | | | |
|---|---|---|---|---|---|
| 2,597,686 | A | | 5/1952 | Turner et al. | |
| D232,265 | S | | 7/1974 | Laidig | |
| 4,072,114 | A | | 2/1978 | Sugiyama et al. | |
| 4,192,243 | A | * | 3/1980 | Blessing | D05B 45/00 112/273 |
| 4,221,317 | A | * | 9/1980 | Fukada | B65H 51/30 112/80.73 |
| D268,113 | S | | 3/1983 | Johnson et al. | |
| 4,408,554 | A | * | 10/1983 | Takiguchi | D05B 19/12 112/243 |
| 4,419,945 | A | | 12/1983 | Nishina | |
| D284,578 | S | | 7/1986 | Yoneda | |
| 4,648,341 | A | | 3/1987 | Kato et al. | |
| 4,649,844 | A | * | 3/1987 | Matsubara | D05B 45/00 112/270 |
| 4,766,827 | A | * | 8/1988 | Matsubara | D05B 45/00 112/242 |
| 4,998,489 | A | | 3/1991 | Hisatake et al. | |
| 5,005,500 | A | | 4/1991 | Kato et al. | |
| 5,095,835 | A | | 3/1992 | Jernigan et al. | |
| 5,167,194 | A | | 12/1992 | Nakagaki | |
| 5,315,945 | A | * | 5/1994 | Nakano | D05B 47/04 112/165 |
| 5,319,566 | A | | 6/1994 | Kongho et al. | |
| 5,323,722 | A | | 6/1994 | Goto et al. | |
| D361,773 | S | | 8/1995 | Jimenez | |
| 5,471,941 | A | * | 12/1995 | Sakuma | D05B 47/04 112/255 |
| 5,711,236 | A | | 1/1998 | Badger | |

(Continued)

*Primary Examiner* — Danny Worrell

(74) *Attorney, Agent, or Firm* — Pate Peterson PLLC; Brett Peterson

(57) ABSTRACT

Techniques for controlling sewing machine stitch length based on thread usage are provided. The techniques include a sewing machine computer storing a stitch length setting and using a thread movement sensor to sense the movement of thread as the thread is drawn from a spool due to the user moving an object relative to a sewing machine needle and thereby drawing thread from the needle and the spool. The techniques also include a sewing machine computer receiving information from the thread movement sensor and determining a length of thread drawn from the spool after formation of a previous stitch, comparing the length of thread with the stitch length setting, and operating a sewing machine motor to create a stitch when the length of thread drawn from the spool after formation of the previous stitch corresponds to the stitch length setting.

19 Claims, 8 Drawing Sheets

(56) References Cited

U.S. PATENT DOCUMENTS

| | | | | |
|---|---|---|---|---|
| 6,012,405 | A * | 1/2000 | Melton | D05B 19/12 112/254 |
| 6,823,807 | B2 * | 11/2004 | Zesch | B65H 59/40 112/278 |
| 6,860,211 | B2 | 3/2005 | Valeriote et al. | |
| 6,883,446 | B2 * | 4/2005 | Koerner | D05B 19/14 112/272 |
| 6,932,007 | B1 | 8/2005 | Beauchamp | |
| 6,990,914 | B2 | 1/2006 | Canan | |
| 7,210,417 | B2 * | 5/2007 | Koerner | D05B 19/14 112/278 |
| 7,325,502 | B2 * | 2/2008 | Konig | D05B 19/14 112/272 |
| 7,373,891 | B2 * | 5/2008 | Koerner | D05B 11/00 112/103 |
| 7,386,361 | B2 | 6/2008 | Nobuyuki | |
| D590,849 | S | 4/2009 | Muller et al. | |
| 7,793,602 | B2 * | 9/2010 | Koemer | D05B 19/14 112/278 |
| 7,854,207 | B2 * | 12/2010 | Kuki | D05B 19/08 112/102.5 |
| 8,037,834 | B2 * | 10/2011 | Shimizu | D05B 19/12 112/278 |
| 8,146,522 | B2 | 4/2012 | Lee et al. | |
| 8,606,390 | B2 * | 12/2013 | Hjalmarsson | D05B 19/10 700/138 |
| 8,960,112 | B2 * | 2/2015 | Brindzik | D05B 19/12 112/475.19 |
| 8,985,038 | B2 * | 3/2015 | Flygare | D05B 19/12 112/470.01 |
| 9,115,451 | B2 * | 8/2015 | Konzak | D05B 19/12 |
| 2003/0188675 | A1 | 10/2003 | Valeriote et al. | |
| 2005/0145149 | A1 * | 7/2005 | Hooke | D05B 69/18 112/315 |
| 2007/0005175 | A1 | 1/2007 | Konig et al. | |
| 2007/0221108 | A1 | 9/2007 | Koerner | |
| 2008/0229991 | A1 * | 9/2008 | Makino | D05B 19/16 112/470.03 |
| 2013/0276686 | A1 * | 10/2013 | Bentley | D05B 19/12 112/470.01 |

* cited by examiner

THREAD SENSING STITCH REGULATION FOR QUILTING MACHINES

PRIORITY

The present application claims the benefit of U.S. Provisional Application Ser. No. 61/637,012, filed Apr. 23, 2012, which is herein incorporated by reference in its entirety.

THE FIELD OF THE INVENTION

The present invention relates to sewing machines. More specifically, the present invention relates to stitch length regulation while using a sewing machine for quilting.

BACKGROUND

Quilting has been both a craft and a hobby for many years. Typically, quilting involves making a quilt or another object from one or more pieces of fabric and may include a soft batting placed between layers of cloth. The pieces of cloth may even be sewn from smaller pieces of cloth in a decorative pattern. The actual quilting of the object is accomplished by sewing through the cloth layers and batting to both attach them together and to form a decorative pattern in the finished object. The quilted pattern which is sewn into the quilt may follow the pattern of individual pieces of cloth used to form the quilt, or may be different patters such as flowers or shapes. While it is understood that many different objects can be quilted, the present application will primarily refer to quilts and discuss the making of actual quilts for simplicity. It will be appreciated that the methods and devices discussed herein will apply to a variety of objects which are sewn in a like manner. Thus, the presently disclosed examples may be applied to various items such as clothing, quilts, blankets, sheets, drapes, etc.

Traditionally, persons have performed all of the sewing by hand, without the use of a machine. As sewing machines became more commonplace, persons would often use a sewing machine to sew individual cloth pieces together to create the larger surface of the quilt, and would then perform the quilting step by hand. As quilting became a more common hobby, quilting machines became available which could perform the quilting step much more quickly and easily than can be done by hand. Quilting machines typically have a larger throat than ordinary sewing machines, and provide increased freedom in moving the quilt relative to the machine (or vice versa). These machines, however, typically require that the user guide the fabric through the machine to sew the fabric.

There is a need for improved control of quilting machines. In particular, there is a need for providing stitch regulation for sewing machines such as quilting machines. There is a need for a sewing machine and for sewing machine control software which maintains consistent stitch length when the speed at which a person moves the cloth through the sewing machine changes.

BRIEF DESCRIPTION OF THE DRAWINGS

Various embodiments of the present invention are shown and described in reference to the numbered drawings wherein.

Figure 1:
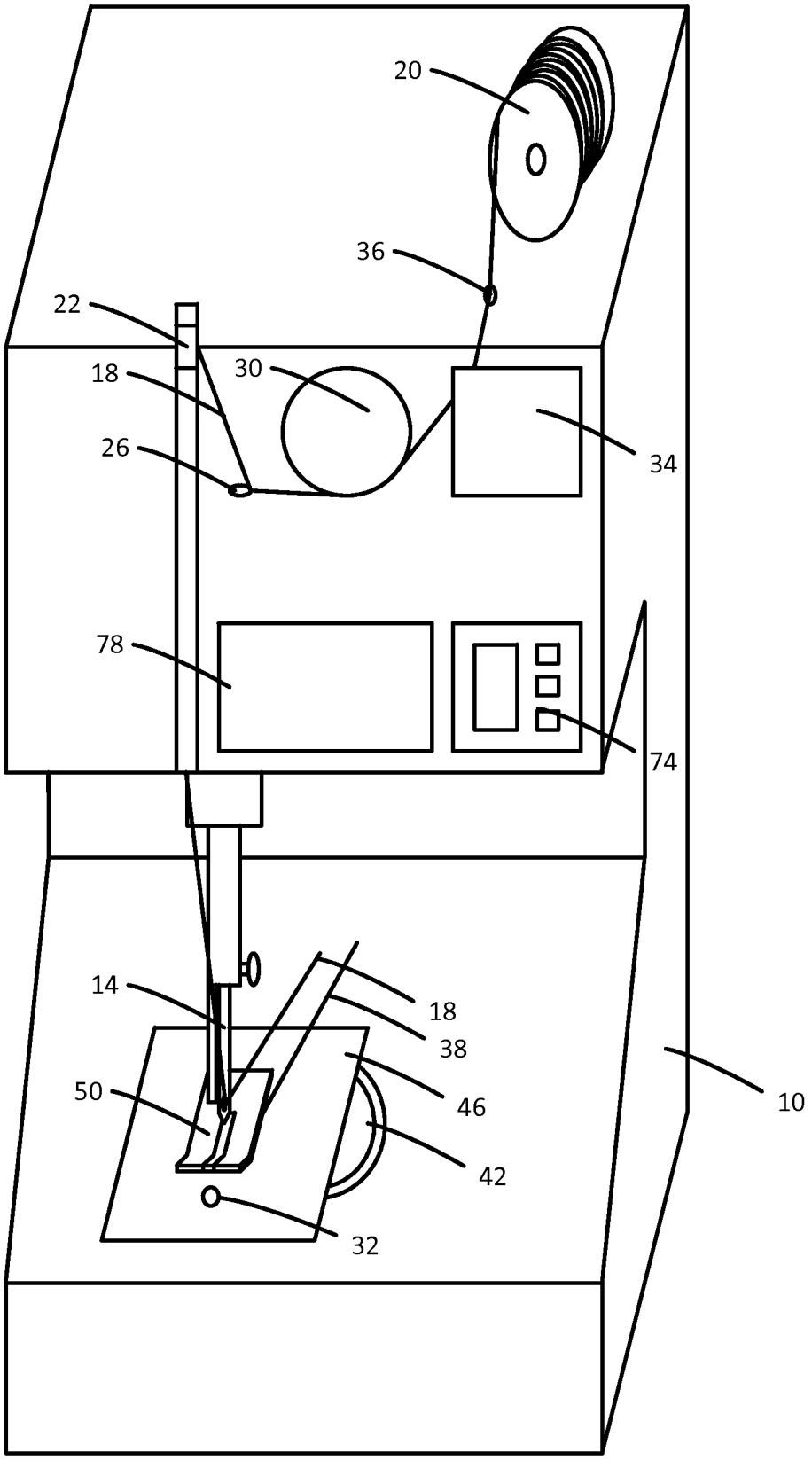
FIG. 1 shows a drawing of a sewing machine according to the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

As used herein, the term quilting machine is used to refer to different types of sewing machines which may be used to sew patterns into cloth. This process of sewing is referred to as quilting to collectively represent sewing patterns into different types of cloth and on different types of objects. These various objects are collectively referred to as a quilt for clarity. Thus, sewing patterns onto various objects is frequently referred to herein as quilting or sewing onto a quilt. The present disclosure encompasses different types of quilting machines such as "sit down" and "stand up" quilting machines. Sit down quilting machines resemble an ordinary sewing machine and often use a foot pedal to control the stitching. The user typically moves the quilt while the machine remains stationary. "Stand up" quilting machines are typically larger and are often attached to rails, allowing the machine to move while the quilt remains stationary. Users often have difficulties with both types of quilting machines in quilting at a consistent speed (i.e. moving the object or the machine at a consistent speed to product uniform stitches). Moving the quilt or machine at an inconsistent speed results in inconsistent stitch lengths and degrades the appearance of the final product.

In one example, a sewing machine is provided which uses a thread movement sensor in combination with a computer controlled sewing machine motor to regulate the stitching of the sewing machine. The thread movement sensor measures the amount of thread used and signals when a stitch should be made based on thread usage. A control system and associated control method are used to govern the operation of the sewing machine motor so that the sewing machine motor produces stitches of even length when a person varies the speed at which the quilt is moved through the sewing machine.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present invention may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible medium of expression having computer-usable program code embodied in the medium.

Any combination of one or more computer-usable or computer-readable media may be utilized. For example, a computer-readable medium may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

Turning now to FIG. 1, a drawing of a sewing machine of the present invention is shown. For clarity in discussing the present invention, only relevant portions of the sewing machine are shown. The sewing machine is understood to include the other necessary structures. The sewing machine 10 includes a sewing needle 14 and associated drivetrain. A motor 66 (not shown) is used to drive the sewing machine needle 18, etc. The upper thread 18 comes from a spool 20 and passes through a thread movement sensor 34, through a tensioner assembly 30, through guides 26, take up lever 22 and related assembly, and through the needle 14. The lower thread 38 is wound around a lower bobbin 42 and passes up through a lower bed plate 46. The sewing machine 10 may include an input button or keypad 74 and a display 78 which may be used to control the operation of the sewing machine 10.

A quilt is held between the lower bed plate 46 and a presser foot 50. Different types of presser foots 50 may be used according to the type of sewing performed by a user. As a user sews the quilt, the quilt is typically moved between the foot 50 and bed plate 46 while the needle 14 repeatedly passes through the quilt and the sewing machine interlocks the upper thread 18 and lower thread 38 to form stitches. When quilting, the user will typically sew without using feed dogs (i.e. having the feed dogs retracted) and will move the fabric or quilt through the sewing machine freehand. This allows the user to sew in any desired shape or pattern. The user may frequently desire to sew at different speeds. A user may speed up the movement of the quilt while sewing a simple portion of a pattern and may move the quilt more slowly while sewing a more difficult portion of a pattern.

Without using feed dogs, a conventional sewing machine does not have any connection between the stitching speed and cloth feed rate as the feed dogs are used to move the cloth a predetermined distance for each stitch. The thread movement sensor 34 is used to control the stitching speed of the sewing machine according to the movement of the cloth by the user. Initially, this seems counterintuitive as the thread usage while sewing is determined by stitching speed. During freehand quilting, however, the thread draw is not governed by stitching speed but by the movement of the cloth through the machine. The thread 18 is drawn out from a spool as the cloth is moved past the needle 14.

The movement sensor 34 will typically be isolated from the reciprocal motion of the needle 14 and take up lever 22 since these parts undergo far more movement during stitch formation than the amount of thread used in forming a stitch. That is to say that while a stitch may often only require between about 0.1 and 0.2 inches of thread, the needle 14 typically moves between 2 and 3 inches and the take up lever 22 move a corresponding amount to allow the top thread 18 to be hooked and interlocked with the bottom thread 38. The thread movement sensor 34 may be isolated from the movement if the needle 14 and take up lever 22 by placing the thread movement sensor between the thread tensioner 30 and thread spool/bobbin rather than between the tensioner 30 and the take up lever 22 or needle 14. Additionally, a thread guide 36 may be located before or after the thread movement sensor 34 to stabilize the thread 18. The thread guide 36 may be placed between the thread movement sensor 34 and the upper thread spool.

Figure 2:
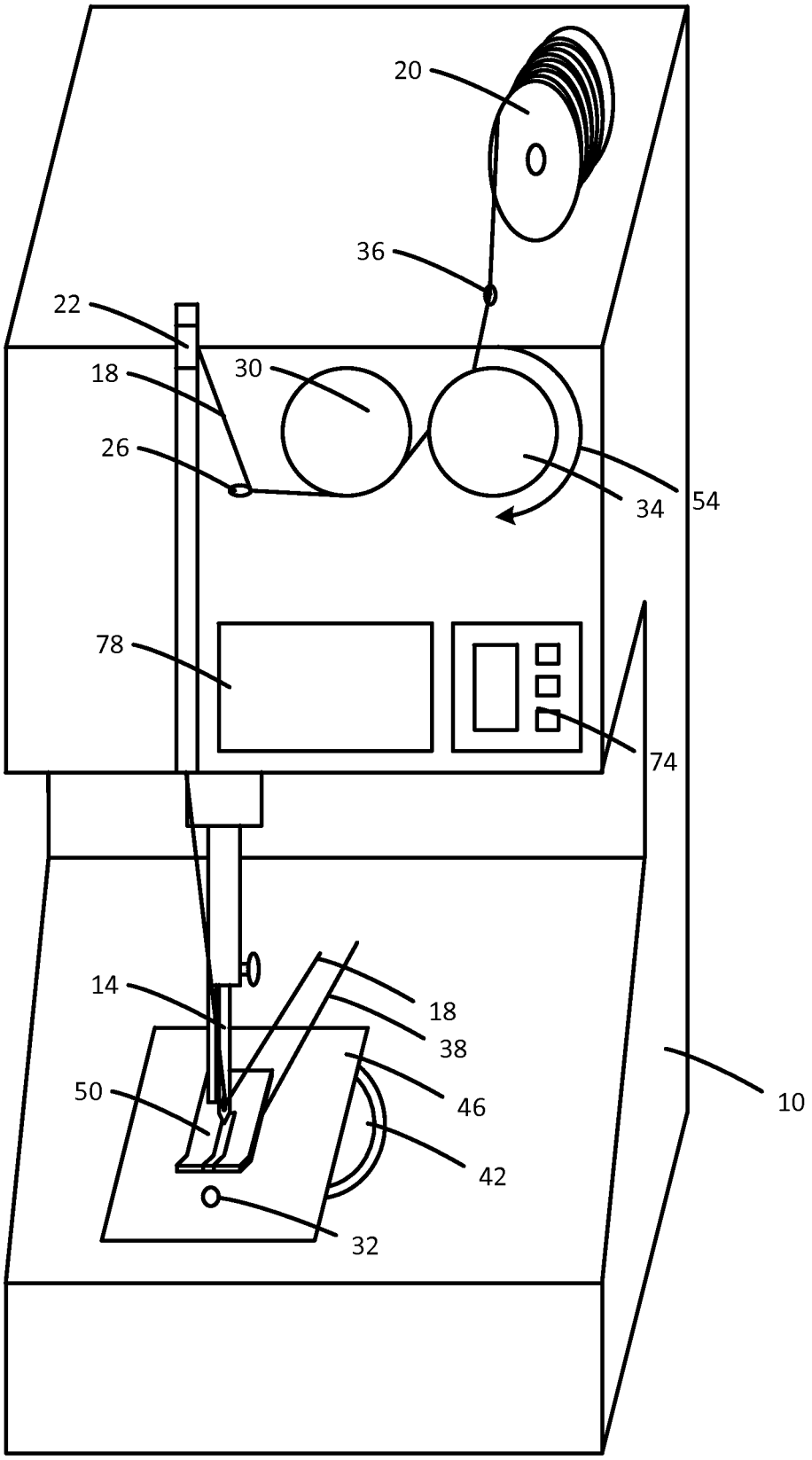
FIG. 2 shows another drawing of the sewing machine of FIG. 1.
Figure 3:
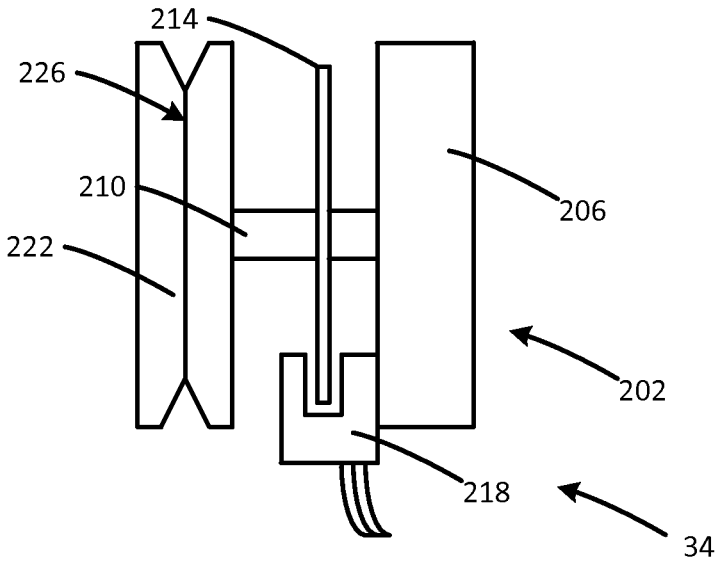
FIG. 3 shows a drawing of a thread movement sensor of FIG. 2.
Figure 4:
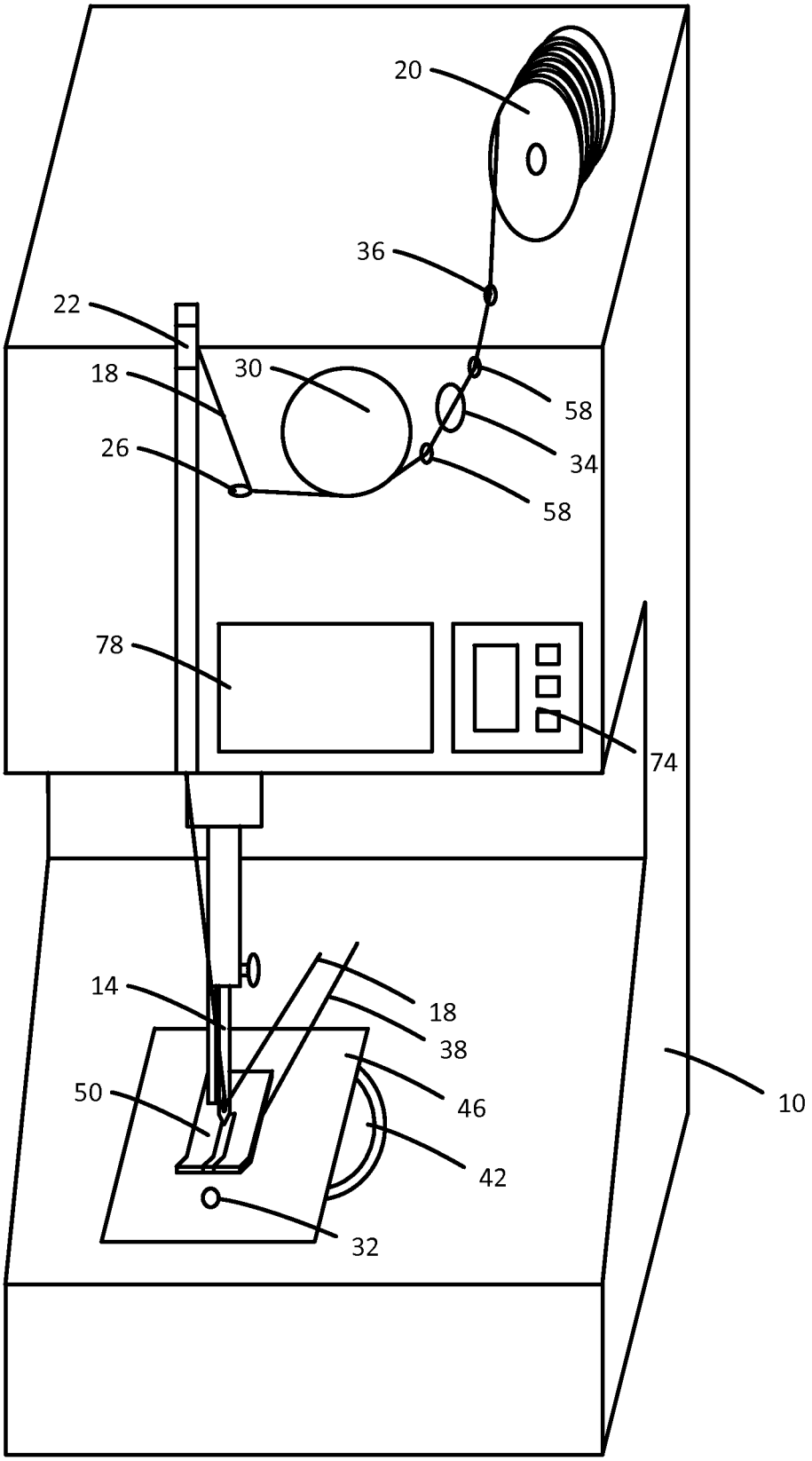
FIG. 4 shows another drawing of the sewing machine of FIG. 1.

FIGS. 2 and 4 show sewing machines 10 illustrating different types of thread movement sensors which may be used. The sewing machine of FIG. 2 uses a rotary encoder for the thread movement sensor 34. The sewing machine of FIG. 3 uses an optical sensor for the thread movement sensor. In each case, the thread movement sensor 34 senses the amount of thread which has been dispensed from the spool of thread.

The thread movement sensor 34 of FIG. 2 is a rotary type sensor, such as a thread movement sensor utilizing a rotary encoder. The sensor 34 will have an encoder portion and also has a thread wheel which engages the top thread 18. The top thread 18 may be wrapped around the thread wheel about 1 full turn as shown by arrow 54, ensuring that the thread 18 does not slip on the thread wheel and that the thread movement out of the spool of thread results in accurately turning the rotary encoder 34.

FIG. 3 shows a side view of a rotary type thread sensor 34 as used in FIG. 2. The sensor 34 includes a rotary encoder 202 with a base 206, shaft 210, encoder wheel 214, and encoder sensor 218 (such as an optical sensor). The base 206 typically serves as a mount for the shaft 210 and sensor 218. The shaft 210 is typically mounted to the base 206 via bearings and holds the encoder wheel 214 (which may often be a wheel having slots formed around the outer circumference thereof) so that the shaft 210 and encoder wheel 214 may rotate relative to the base. A thread wheel 222 may be mounted to the shaft 210 so that these rotate together. The thread wheel 222 receives the top thread 18. As discussed, the top thread 18 may often be wrapped around the thread wheel 222 to reliably engage the thread wheel, and the thread wheel 222 may have a groove 226 formed therein to receive the top thread 18. As thread 18 is pulled from the spool of thread 20 and used by the sewing machine 10 to stitch, the thread rotates the thread wheel 222 and the encoder wheel 214, causing a signal to be sent to the computer 62 from the encoder sensor 218. The signal is indicative of the amount of rotation of the encoder wheel 214 and, by correlation, indicative of the distance of thread which has been used.

The thread movement sensor 34 of FIG. 4 is an optical sensor. The optical sensor 34 may be similar to that used on an optical computer mouse and may detect the movement of the thread 18 past the optical sensor 43. A pair of thread guides 58 may be used to keep the thread 18 centered over the optical sensor 34. The sensor 34 can measure the linear movement of the thread past the sensor. In both of the configurations shown in FIGS. 2 and 4, an additional guide or friction member such as a light tensioner may be placed between the thread movement sensor 34 and the spool of thread to make the detection of thread movement as accurate as possible.

Figure 5:
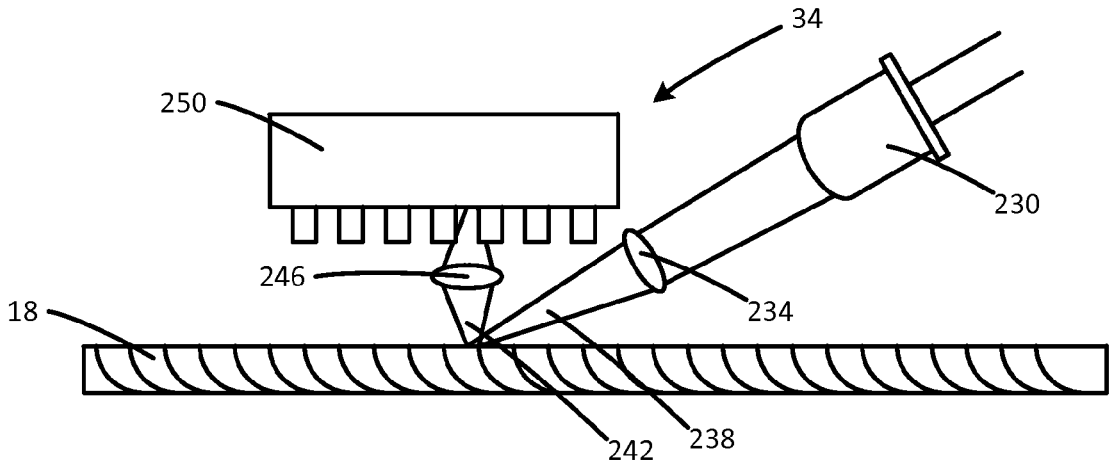
FIG. 5 shows a drawing of a thread movement sensor of FIG. 4.

FIG. 5 shows an example optical sensor as discussed in relation to FIG. 4. The optical sensor 34 may include an optical emitter 230 such as an LED. An emitter lens 234 may be used to focus emitted light 238 onto the thread 18. The reflected light 242 may be focused by a receiver lens 246 onto an optical sensor 250. The optical sensor may use movement of a reflected light image across the sensor 250 (i.e. across pixels of the sensor) to track the movement of the thread 18 and this movement information may be sent to the computer 62.

In both scenarios, the thread movement sensor 34 is used in substantially the same manner. The sensor 34 sends information regarding the movement of the thread 18 to the computer 62 such that the computer may track the thread movement and operate the sewing machine accordingly. During freehand quilting, a person will move the quilt through the sewing machine to sew a desired pattern in the quilt. After a stitch is completed, movement of the quilt will cause thread to be dispensed from the spool of thread since the previous stitch site is moving away from the needle with the thread 18 attached thereto and additional thread is pulled through the needle 14, through the thread movement sensor 34, and from the thread spool 20. The system monitors the length of thread which is dispensed and triggers a subsequent stitch when a predetermined amount of thread has been dispensed.

Figure 6:
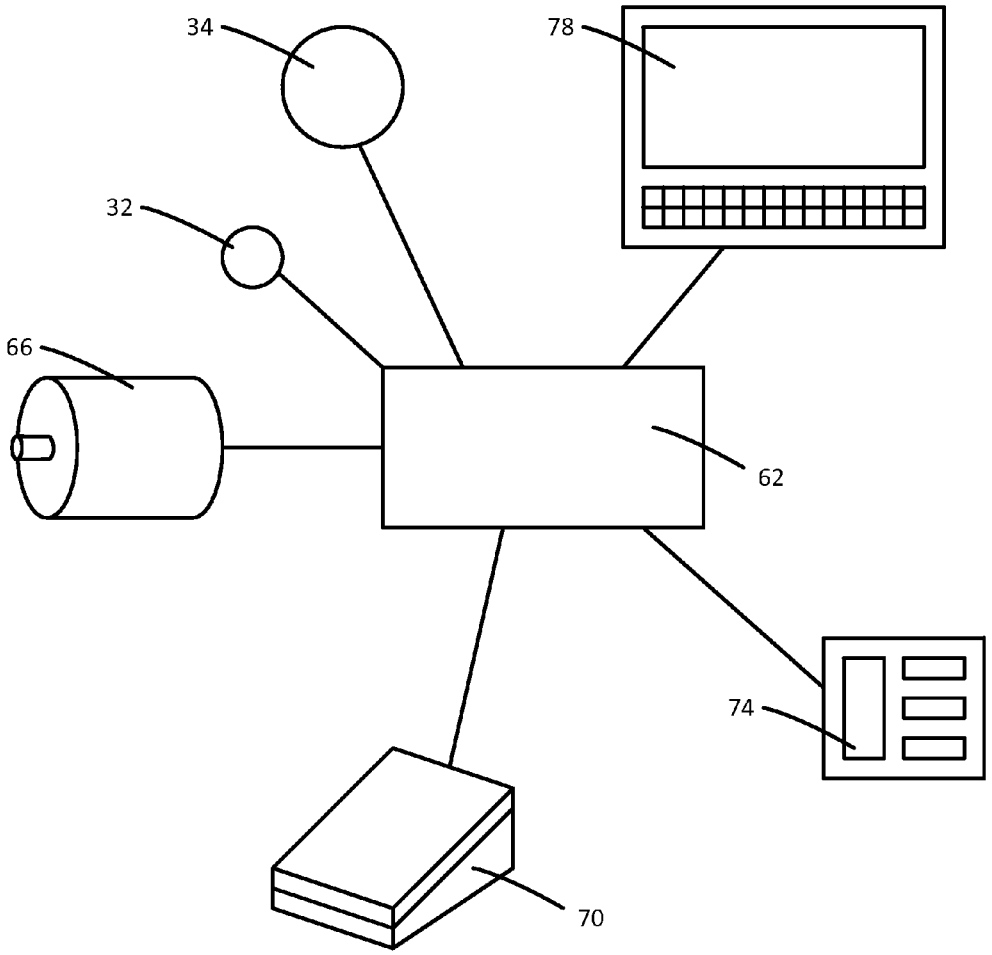
FIG. 6 shows a schematic drawing of the control system of the sewing machine of FIG. 1.

FIG. 6 shows a schematic view of the equipment associated with the present invention. A control computer 62 is used to control the operation of the various other components. The thread movement sensor 34 detects the movement of the thread 18 as it is drawn from the spool of thread 20, measuring how much thread is dispensed. The computer 62 receives thread movement information from the thread movement sensor 34 and monitors the amount of thread which is dispensed. The computer 62 may receive a user inputted stitch length via the input button or keyboard 74 or the display unit 78. The computer 62 triggers or signals stitches according to how much thread 18 has been dispensed. In order to create stitches, the computer 62 controls the speed of the sewing machine motor 66 to thereby control the stitching speed of the sewing machine 10. The computer 62 may include a motor speed controller such as a PWM motor controller or the like. Alternatively, a separate motor controller may be provided. The motor controller may receive a signal from the computer 62 which is indicative of motor speed (such as a varying voltage signal, a varying frequency signal, a varying pulse width signal, etc.) and operate the motor 66 at a speed which is correlated to the signal. A foot pedal 70 or another button or keyboard 74 may be used by a person to start or stop the sewing machine. An input device such as a keyboard 74 and or display unit 78 may be provided to allow the person to browse through the computer settings (such as stitch length) and to change those settings.

Figure 7:
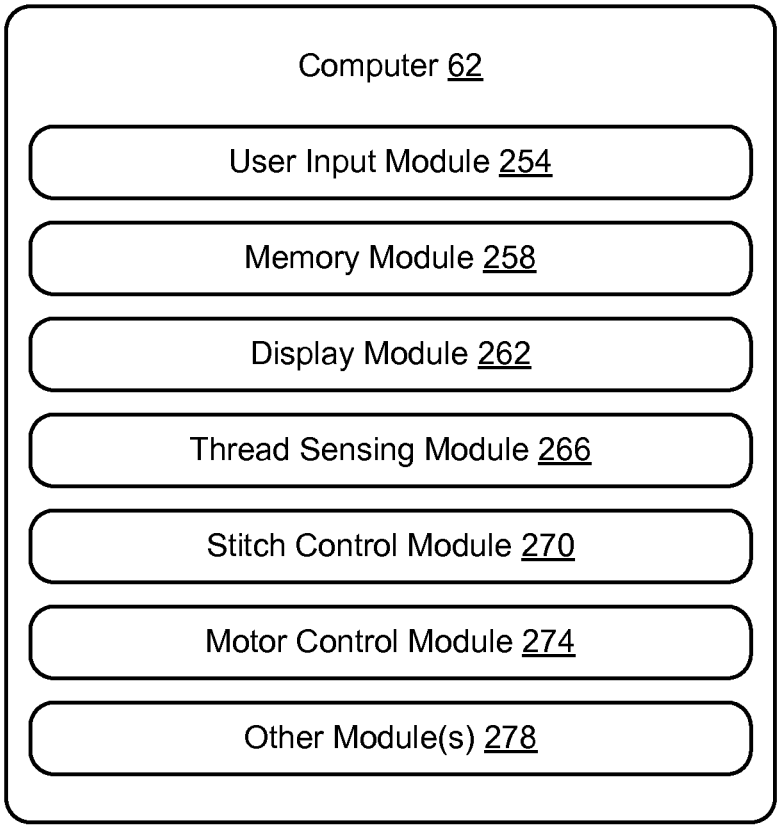
FIG. 7 shows a schematic diagram of the sewing machine computer.

FIG. 7 shows a schematic diagram of the computer 62. The computer 62 may include a user input module 254, a memory module 258, a display module 262, a thread sensing module 266, a stitch control module 270, a motor control module 274, and other modules 278 as are desirable. The user input module 254 may receive user inputs for operation of the sewing machine 10. For example, the user input module 254 may receive a stitch length input from a user. Additionally, the user input module 254 may receive operational inputs from a user to control the sewing machine 10. The user input module 254 may receive input from the keyboard 74 or foot pedal 70 to start or stop the sewing machine 10.

The memory module 258 may store user input or settings and may store other software, firmware, or information useful for the operation of the sewing machine 10. The display module 262 may interact with a user interface such as the display 78 to provide information to the user. The display module 262 may provide the operational status of the sewing machine 10, sewing machine configuration or settings, etc. The display module 262 may display a user selected stitch length setting. The thread sensing module 266 may receive information from the thread movement sensor 34. The thread sensing module 266 may receive incremental movement data and/or absolute position data from the thread movement sensor 34 as the thread 18 moves through the thread movement sensor 34. The thread sensing module 266 (or stitch control module 270) may include a thread movement factor relating the movement data from the thread movement sensor 34 to the measured movement of the thread 18. The thread movement factor may relate pixels of movement on an optical sensor 34 or degrees of rotation on a rotary sensor 34 to inches (or mm) of thread movement. The thread movement is the length of thread withdrawn from the spool 20 of thread past the thread movement sensor 34 caused by movement of the quilt pulling thread 18 from the needle 14.

The stitch control module 270 may receive information regarding thread movement, process this information, and indicate when stitches should occur based on the user entered stitch length. The stitch control module 270 may include a stitch correction factor which correlates the required thread length with an entered stitch length. Because the thickness of a quilt is non-zero, the length of thread required to perform a stitch is longer than the entered stitch length. The stitch correction factor may be a fixed value as many quilts will compress to a similar thickness under a presser foot 50 and the additional thread length may be approximately equal to the compressed thickness of the quilt. Alternatively, the stitch correction factor may be a value selected by the user, such as by allowing the user to select between a thin quilt or a thick quilt, resulting in a smaller or a larger stitch correction factor respectively. In determining when to signal a stitch, the required thread length (effectively a corrected stitch length) may equal the user entered stitch length plus the stitch correction factor.

The stitch control module 270 may operate the sewing machine to create stitches. The stitch control module may determine if the user has started the sewing machine operation by pressing a button on the keyboard 74 or depressing the foot pedal 70. If the user has started operation of the sewing machine, the stitch control module 270 may receive thread movement information and compare the thread movement information to the stitch length (or corrected stitch length) and signal a stitch when the thread movement from the previous stitch equals the stitch length. The stitch control module may operate the sewing machine 10 to create stitches at a slow present speed if the user has pressed a button or depressed the foot pedal 70 to operate the sewing machine but the thread movement rate (length of thread per unit time) is below a set threshold. As the user quilts, the movement of the quilt (and the thread movement rate) will usually exceed the minimum threshold and allow the computer 62 to operate the sewing machine motor 66 at a desired speed to create the user selected stitch length. The stitch control module 270 may cease operation of the sewing machine if the user presses a button on the keyboard 74 to stop the sewing machine or no longer depresses the foot pedal 70.

In operating the motor 66 to create stitches, the stitch control module 270 (or motor control module 274) may operate the motor 66 at an average stitch rate instead of trying to operate the motor at a precise speed or starting and stopping the motor to precisely place each stitch when the thread movement indicates the stitch. The stitch control module 270 may have a stitch average setting which indicates a number of stitches to use in determining an average motor speed for sewing machine operation. The stitch control module 270 may use the frequency of stitch requests for the last N number of stitches (often 2-5 stitches) to determine the average stitch request rate for these previous N stitches and may operate the motor 66 at the speed necessary to achieve this average stitch rate. The motor speed may be adjusted slightly with each stitch as variances in the stitch request timing will alter the average motor speed for the previous N stitches, but the motor will operate more smoothly as it will not try to start and stop or change speed abruptly with each stitch.

The motor control module 274 may receive a signal from the stitch control module such as a variable voltage signal, a variable frequency signal, or a variable pulse width signal which represents a desired motor speed. The motor controller module 274 may use this signal to provide power to the motor to operate the motor at a desired speed. The motor control module 274 may include a PWM (pulse width modulation), VFD (variable frequency drive), or similar motor drive for controlling the operation of the motor 66. The motor control module 274 may alternatively include a stepper or servo drive used in combination with a stepper or servo motor 66, and may use a rotary encoder on the motor 66 to assist in controlling the speed of the motor 66.

Figure 8:
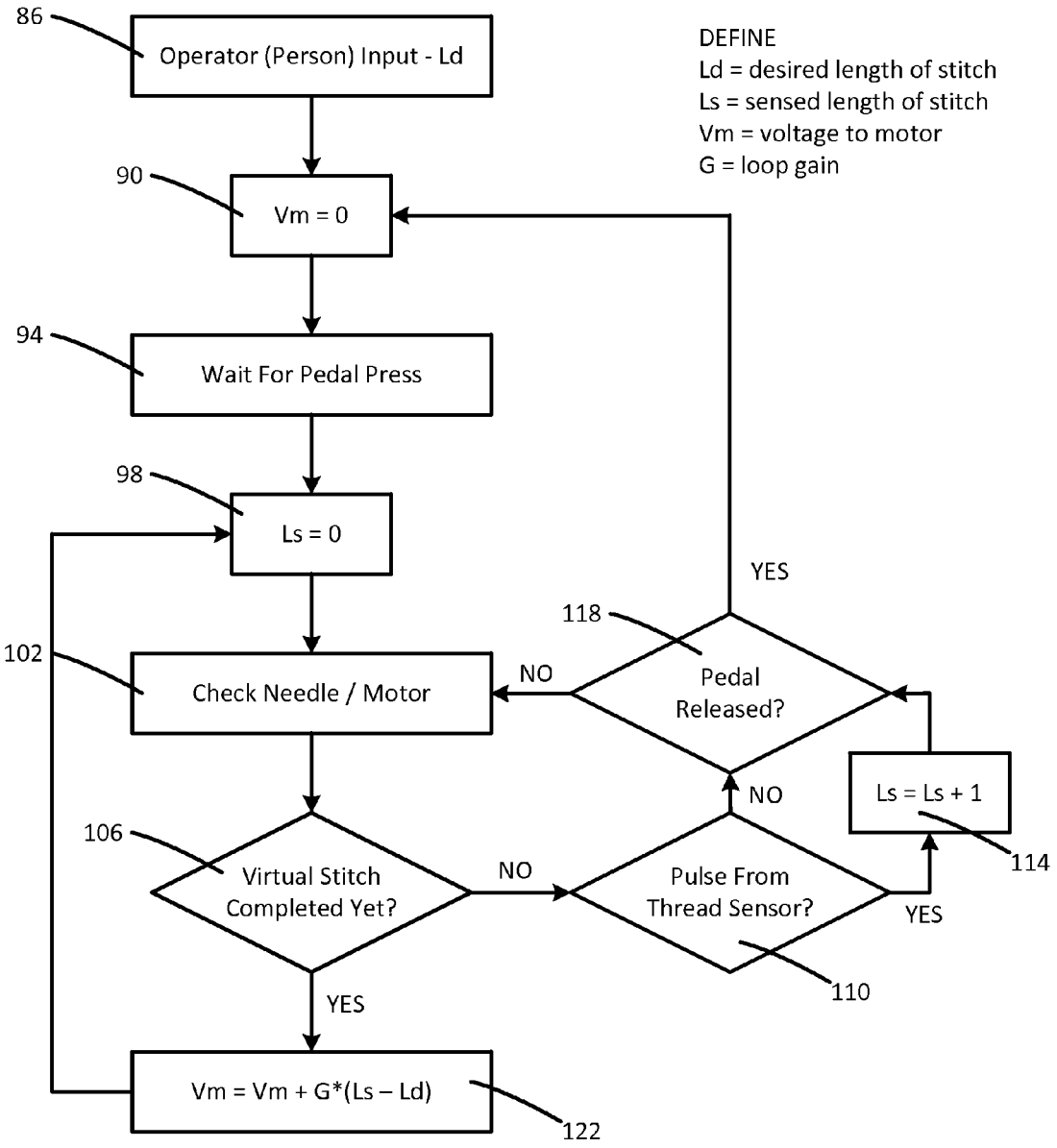
FIG. 8 shows a flow chart illustrating principles of operation of the control system of the present invention.

FIG. 8 shows a flow chart which illustrates aspects of how the system regulates the length of stitches as a person sews. The flowchart and block diagrams in the flow diagrams illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer 62 may regulate the speed of the sewing machine motor 66 through a motor controller or the like. For simplicity, the computer 62 is directly referred to as controlling the motor 66. The computer 62 receives a selection 86 of a desired stitch length Ld from a person. The computer 62 may receive a selection 86 of the stitch length by receiving it via keyboard 74, display 78, a dial, etc. In an initial state, the computer 62 causes the motor 66 to be stopped 90. The computer 62 may output a signal or lack thereof such that a motor voltage Vm is zero or such that a motor controller otherwise causes the motor 66 to stop. It is appreciated that some motor controllers such as a stepper motor controller may apply a voltage to affirmatively hold a motor in a position while stopped. The present example discusses the control of the motor as a variable voltage signal for simplicity in showing how the motor speed is varied to provide uniform stitches. The computer 62 receives 94 an input from the person to start sewing. Such an input 94 may be the person pressing the foot pedal 70. The computer 62 may receive an input 94 of the person pressing the pedal 70 or a keyboard start/stop button 74, indicating that the person desires to start sewing.

When the computer 62 detects 94 such a start input, the computer applies a voltage Vm to the motor 66 so that the sewing machine begins to form stitches. The computer 62 may apply a set minimum voltage to the motor 66 so that the motor operates at a set minimum speed until sufficient thread movement/usage information is received to operate the motor 66 from the thread usage information. The computer 62 sets a sensed stitch length Ls counter to zero 98 and monitors 102 operation of the motor 66. The computer 62 decides 106 if a "virtual" stitch has been completed. That is to say that the computer 62 determines if sufficient thread 18 has been withdrawn from the spool of thread 20 in order to form a stitch of the length selected 86 by the person who is quilting. The computer 62 receives thread usage information from the thread movement sensor 34 as thread is withdrawn from the thread spool 20.

The computer 62 compares the sensed stitch length Ls to the desired stitch length Ld to determine if Ls is greater than or equal to Ld. If the computer 62 decides 106 that a "virtual" stitch has not been completed (i.e. that sufficient thread 18 has not been withdrawn from the spool 20 to create a stitch of the desired length), the computer 62 does not signal the creation of a stitch (or virtual stitch). The computer 62 detects 110 signals from the thread movement sensor 34. The signals from the thread movement sensor may be incremental or absolute signals, and the signal may be indicative of the incremental amount of thread used or the total amount of thread used since the last stitch was formed. If a signal from the thread sensor 34 indicates that an amount of thread 18 has been withdrawn from the spool 20, the computer 62 may add 114 that amount of thread to the sensed stitch length Ls. Thus, an incremental amount of thread usage may be added to the previous value of thread usage since the last stitch and this value may be stored as the sensed stitch length Ls which represents the amount of thread withdrawn from the spool 20 after the formation of the previous stitch or "virtual" stitch. If the thread movement sensor 34 provides absolute movement data instead of incremental movement data, the computer may store the signal value from the thread movement sensor 34 from the previously formed stitch and subtract this from the current signal value from the thread movement sensor 34 to determine the amount of thread Ls withdrawn after the previous stitch.

The computer 62 senses 118 if the pedal 70 has been released or alternatively if a start/stop button 74 has been pressed (indicating that the person desires to stop sewing). The start/stop button 74 may operate similar to a pedal where the person holds the button 74 continuously while sewing.

Alternatively, the start/stop button 74 may be pressed once and released to start sewing and pressed and released again to stop sewing.

If the pedal 70 has been released or the computer otherwise receives a signal from the person sewing to stop sewing, the computer 62 stops the motor 66 as indicated at 90, often by providing zero voltage to the motor 90. If the pedal 70 has not been released (or the computer 62 has not otherwise received an indication from the person to stop sewing), the computer 62 again monitors 102 operation of the motor 66 and decides 106 if a virtual stitch has been completed. If the computer 62 decides 106 that a virtual stitch has not been completed, the computer detects 110 the next signal from the thread sensor 34 and continues as discussed. If the computer 62 determines that a virtual stitch has been completed, the computer 62 requests a stitch and may then adjust 122 the motor speed such as by changing the voltage which is applied to the motor. Typically, the computer 62 may adjust the motor speed by increasing or decreasing the voltage applied to the motor by a gain constant G multiplied by the difference between the sensed stitch length Ls and the desired stitch length Ld as indicated at 122. In this manner the computer controls the length of stitches.

Thus, when the sewing machine is operating the computer 62 monitors the amount of thread withdrawn from the spool 20. If the rate of thread usage is below a threshold, the computer 62 may operate the motor 66 at a slow predetermined rate. If the rate of thread usage is above a threshold, the computer 62 monitors the length of thread withdrawn from the spool 22 to control the operation of the motor 66 and thus the needle 14 and associated drivetrain. For each signal from the thread movement sensor 34, the computer 62 may determine the sensed stitch length Ls. The sensed stitch length is the amount of thread 18 withdrawn from the spool 20 after the previous indicated stitch. If the computer 62 determines that the person is still operating the sewing machine to sew, the computer continues to sense the length of the current stitch and compare this to the desired length of stitch. When the sensed length of stitch is greater than or equal to the desired length of stitch, the computer 62 indicates that a stitch should be made. A thread movement factor and stitch correction factor may be used to correlate the output from the thread movement sensor 34 to the length of thread withdrawn from the spool 20 and to correct for the thickness of the quilt being sewn.

In one example, the computer 62 may monitor the length of thread 18 which is withdrawn from the spool 20 (steps 102 through 118), indicate when stitches should occur, determine a frequency at which stitches should occur, and adjust the motor speed to stitch at this frequency. The computer 62 may set the motor speed according to the average frequency of a predetermined number of the most recent stitches so that the motor operates more smoothly instead of changing speed for every stitch. Motor speed for an initial stitch may be set from the rate of thread usage (i.e. extrapolating the time to complete an initial stitch from the rate of withdrawing thread form the spool 20) and motor speed for subsequent stitches may be set from average stitch frequency. Motor speed (revolutions per minute) may be related to stitch frequency (stitches per minute or second) and the sewing machine drivetrain mechanics (stitches per motor revolution).

In another example, the computer 62 may set the motor speed according to the time/rate of formation of the current stitch. As thread 18 is withdrawn from the spool 20, the computer may track the elapsed time from the previously formed/indicated stitch and, when sufficient thread 18 is withdrawn from the spool 30 to signal a stitch, determine the stitch frequency and motor speed from the single stitch. This may more accurately form stitches at the expense of motor and drivetrain stress and may not be suitable for all sewing machines.

In another example, the computer 62 may sense when the sewing machine completes actual stitches (such as from needle position or sensed or calculated motor speed and the drivetrain mechanics), measure the amount of thread used during a stitch (Ls, determined via sensor 34), compare Ls to Ld, and adjust the motor speed according to the difference between Ls and Ld. Again, the computer may operate the motor according to the average of a predetermined number of stitches to smooth the motor operation. The sewing machine computer 62 may sense whether the needle is up or down with a position sensor and this information may be readily available to the computer 62 to determine if a stitch has been completed.

In both of these examples, the computer 62 tracks the amount of thread which is used via thread movement sensor 34 and controls the speed of the motor 66 according to the amount of thread used. As the person moves the fabric through the sewing machine (or moves the machine relative to the fabric for a stand up quilting machine), moving the fabric faster will draw thread 18 out of the spool 20 faster and cause the motor 66 to operate faster.

The computer 62 may also operate the sewing machine motor 66 at a set minimum speed while the pedal 70 is pressed (or if the start button 74 has been pressed). For very slow sewing speeds, it can be difficult for the computer 62 to control the motor 66 appropriately. If desired, a predetermined minimum motor speed may be set in the computer 62. When the pedal 70 is pressed, the motor 66 may be operated at the predetermined minimum speed and the sewing machine stitches at this minimum speed. A threshold quilting movement speed would be correlated to the set minimum stitching speed by the selected stitch length. The threshold quilting speed (inches or mm per unit time) would equal or be correlated to the threshold thread usage rate (inches or mm per unit time) and correlated to the minimum stitching speed by the stitch length.

If the person continues to move the fabric through the machine at a rate which does not exceed this threshold quilting speed, the computer 62 may continue to operate the motor 66 at the set minimum speed. When the person quilts faster than the threshold quilting speed, the computer 62 may control the motor speed according to the thread usage as determined by sensor 34. If the person again quilts below the threshold quilting speed, the computer 62 again operates the motor 66 at the set minimum speed.

In addition to the set minimum motor speed, the computer 62 may select an initial motor speed according to how far a person initially presses the foot pedal 70 and transition into closed loop control over stitch length (motor speed), allowing the computer 62 to more smoothly transition into closed loop control over the motor speed.

According to another example, the computer 62 may stop the motor 66 and thereby stop the sewing machine 10 from forming stitches if the person stops moving the quilt. The computer 62 may determine that a person is not sewing if the thread movement sensor 34 senses no thread movement as this indicates that no thread is withdrawn from the spool 20 and the quilt is not moving past the needle 14. The computer 62 may then stop the motor 66. If the person resumes moving the quilt past the needle 14, the computer 62 may detect thread usage and resume stitching by operating the motor 66. In this manner, the computer 62 may automatically determine if the person is sewing or not and only operate the motor 66 is the person is moving the quilt relative to the needle to sew. If the computer 62 senses that the person has released the pedal 70 (or operates a button 74), the computer 62 stops the motor 66.

In yet another example, the computer 62 may utilize an optical quilt movement sensor 32 located in the sewing machine 10 adjacent the needle 14. The optical quilt movement sensor 32 may contain hardware and function as described with respect to FIG. 5. The optical quilt movement sensor 32 may assist the computer 62 in determining if the quilt is being moved by the user. The optical quilt movement sensor 32 may detect movement of a quilt which is placed between the presser foot 50 and the bed plate 46. When the computer 62 has received an indication from the user to begin sewing, the computer 62 may 'arm' the motor 66. The computer 62 may monitor the quilt movement sensor 32 to detect movement of the quilt in addition to monitoring the thread movement sensor 34 to detect movement of the quilt. If the computer detects movement of the quilt at one or more of the quilt movement sensor 32 and the thread movement sensor 34, the computer 62 may apply power to the motor 66 and begin forming stitches. The computer may operate the motor 66 at a predetermined low speed if thread usage is below a threshold rate, and may operate the motor at a variable speed to regulate stitch length if thread usage is above a threshold rate. The thread movement sensor provides a significant improvement in providing uniform stitches in a simple and robust system. While less accurate in regulating stitches, a quilt movement sensor 32 may more easily detect the start of quilt motion and allow for more accurate first stitch formation. In some situations, such as during slow quilt movement, the quilt movement sensor 32 may provide additional input to the computer in addition to the thread movement sensor 34 and the combined input may provide improved stitch regulation.

In addition to controlling the stitch length while quilting or sewing freehand, the disclosure provides several additional benefits. The system may inherently provide thread breakage sensing and stop the sewing machine. If the top or bottom thread breaks, thread usage stops because thread is not immediately withdrawn for a stitch if the previous stitch did not form properly. Thus, the computer 62 can immediately sense if a thread has broken and stop the sewing machine motor 66. Similarly, the computer 62 can sense if the spool or bobbin is empty since this also results in a stitch that does not form properly and stops usage of the upper thread. The computer 62 can sense this immediately and stop the motor 66. The disclosure is also advantageous because the stitch length may be regulated based off of thread usage and the computer 62 does not need to rely on time. This may be used to simplify both the hardware and firmware.

The above description of illustrated examples of the present invention, including what is described in the Abstract, is not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

What is claimed is:

1. A computer implemented method for controlling stitch length in a sewing machine comprising:

a sewing machine computer receiving a stitch length setting;

the sewing machine computer determining a target thread length required to form a stitch at the stitch length;

the computer receiving an indication to begin sewing from a user;

a thread movement sensor sensing the movement of thread as the thread is drawn from a spool due to the user moving an object being sewn by the user relative to a sewing machine needle and thereby drawing thread from the needle;

the computer receiving information from the thread movement sensor and determining a length of thread drawn from the spool after formation of a previous stitch;

the computer comparing the length of thread drawn from the spool after formation of the previous stitch with the target thread length; and the computer operating a sewing machine motor to create a stitch when the length of thread drawn from the spool after formation of the previous stitch equals the target thread length.

2. The method of claim 1, wherein the method more specifically comprises the computer operating the motor at a predetermined speed if a rate of drawing thread from the spool does not exceed a threshold value; and the computer operating the motor to create a stitch when the length of thread drawn from the spool after formation of the previous stitch equals the target thread length if a rate of drawing thread from the spool exceeds the threshold value.

3. The method of claim 1, wherein the step of the computer operating a sewing machine motor to create a stitch when the length of thread drawn from the spool after formation of the previous stitch equals the stitch length setting more specifically comprises:

the computer indicating a stitch when the length of thread drawn from the spool after formation of the previous stitch equals the target thread length; and the computer operating the motor to create stitches based on an average frequency of indicated stitches.

4. The method of claim 3, wherein the method more specifically comprises:

the computer operating the motor to create stitches based on an average frequency of a predetermined number of previous indicated stitches.

5. The method of claim 1, wherein the method more specifically comprises:

the computer stopping the motor if the thread movement sensor does not detect thread being withdrawn from the spool; and the computer operating the motor to create stitches if the thread movement sensor does detect thread being withdrawn from the spool.

6. The method of claim 1, wherein the thread movement sensor is an optical sensor having an optical emitter and an image sensor and wherein the thread is drawn therethrough such that the image sensor detects movement of the thread.

7. The method of claim 1, wherein the thread movement sensor is a rotary sensor having a thread wheel attached thereto, and wherein drawing thread from the spool rotates the thread wheel and provides thread movement data to the computer.

8. A computer implemented method for controlling stitch length in a sewing machine comprising:

a sewing machine computer receiving a stitch length;

the sewing machine receiving an object to sew thereon;

the sewing machine computer sensing movement of the object relative to a sewing machine;

the computer operating the sewing machine at a predetermined stitching speed when a rate of movement between the object and the sewing machine is less than a threshold value; and the computer operating the sewing machine at a variable stitching speed according to the rate of movement between the object and the sewing machine when the rate of movement between the object and the sewing machine is greater than the threshold value such that stitches are formed at the stitch length.

9. The method of claim 8, wherein the computer operates the sewing machine at said variable stitching speed by sensing an amount of thread used in forming a preceding stitch and adjusting the variable stitching speed according to said amount of thread used so as to form a subsequent stitch at said stitch length.

10. The method of claim 8, wherein the computer operates the sewing machine at said variable stitching speed by sensing an amount of thread withdrawn from a spool of thread after forming a preceding stitch, determining when a stitch should be formed by comparing the withdrawn amount of thread with a target thread length required to form a stitch at the received stitch length, and adjusting a sewing machine motor speed according to said amount of thread used so as to form a subsequent stitch at said desired stitch length.

11. The method of claim 9, wherein the method more specifically comprises the computer determining a length of thread which is withdrawn from a spool after forming a preceding stitch to determine when the subsequent stitch should be formed.

12. The method of claim 9, wherein the method more specifically comprises:

the computer receiving information from a thread movement sensor and determining a length of thread drawn from a spool after formation of a previous stitch;

the computer comparing the length of thread drawn from the spool after formation of the previous stitch with a target thread length required to form a stitch at the stitch length setting; and the computer operating the sewing machine to create a stitch when the length of thread drawn from the spool after formation of the previous stitch equals the target thread length.

13. The method of claim 12, wherein the step of the computer operating the sewing machine to create a stitch when the length of thread drawn from the spool after formation of the previous stitch equals the stitch length setting more specifically comprises:

the computer indicating a stitch when the length of thread drawn from the spool after formation of the previous stitch equals the stitch length setting; and the computer operating the sewing machine to create stitches based on an average frequency of indicated stitches.

14. The method of claim 13, wherein the method more specifically comprises:

the computer operating the sewing machine to create stitches based on an average frequency of a predetermined number of previous indicated stitches.

15. A computer implemented method for controlling stitch length in a sewing machine comprising:

a sewing machine computer receiving a desired stitch length;

the computer operating the sewing machine to form a first stitch in an object as the object is moved through the sewing machine;

the sewing machine sensing a length of thread used in forming the first stitch; and the computer controlling a sewing machine motor to adjust a stitching speed according to said length of thread to thereby form a second stitch at said desired stitch length.

16. The method of claim 15, wherein the computer operates the sewing machine to form stitches at an average rate determined from length of thread used in forming a predetermined number of preceding stitches.

17. The method of claim 15, wherein movement of the object moves the first stitch away from a sewing machine needle and thereby draws said length of thread through the needle and wherein the computer receives thread movement information from a thread movement sensor to sense said length of thread.

18. The method of claim 15, wherein the method comprises:

the sewing machine computer determining a target thread length required to form a stitch at the desired stitch length;

the sewing machine computer sensing a length of thread drawn from a spool of thread after forming a stitch;

the sewing machine computer comparing the length of thread drawn from the spool with the target thread length; and the sewing machine computer operating the sewing machine to form a stitch when the length of thread drawn from the spool equals the target thread length.

19. The method of claim 18, wherein the step of the sewing machine computer operating the sewing machine to form a stitch when the length of thread drawn from the spool equals the target thread length more specifically comprises:

the sewing machine computer indicating a stitch when the length of thread drawn from the spool equals the target thread length; and the sewing machine computer operating the sewing machine to form stitches according to an average frequency of a predetermined number of recent indicated stitches.

* * * * *